US008965028B2

(12) United States Patent
Oishi et al.

(10) Patent No.: US 8,965,028 B2
(45) Date of Patent: Feb. 24, 2015

(54) SPEAKERS, HEADPHONES, AND KITS RELATED TO VIBRATIONS IN AN AUDIO SYSTEM, AND METHODS FOR FORMING SAME

(71) Applicant: Skullcandy, Inc., Park City, UT (US)

(72) Inventors: Tetsuro Oishi, Park City, UT (US); Sam Noertker, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 13/969,188

(22) Filed: Aug. 16, 2013

(65) Prior Publication Data

US 2014/0056459 A1 Feb. 27, 2014

Related U.S. Application Data

(60) Provisional application No. 61/692,570, filed on Aug. 23, 2012.

(51) Int. Cl.

| | |
|---|---|
| ***H04R 25/00*** | (2006.01) |
| ***H04R 1/10*** | (2006.01) |
| ***H04R 31/00*** | (2006.01) |
| *H04R 1/00* | (2006.01) |

(52) U.S. Cl.

CPC . *H04R 1/10* (2013.01); *H04R 31/00* (2013.01)
USPC ..... 381/370; 381/398

(58) Field of Classification Search

USPC ..... 381/370, 398
See application file for complete search history.

(56) References Cited

U.S. PATENT DOCUMENTS

| | | | |
|---|---|---|---|
| 7,187,948 | B2 | 3/2007 | Alden |
| 7,395,090 | B2 | 7/2008 | Alden |
| D623,627 | S | 9/2010 | Alden et al. |
| D624,057 | S | 9/2010 | Kelly et al. |
| D641,003 | S | 7/2011 | Alden |
| 8,014,824 | B2 | 9/2011 | Alden |
| D650,356 | S | 12/2011 | Alden et al. |
| D656,129 | S | 3/2012 | Kelly et al. |
| D665,776 | S | 8/2012 | Alden et al. |
| D665,777 | S | 8/2012 | Alden et al. |
| D673,136 | S | 12/2012 | Kelly et al. |
| D673,140 | S | 12/2012 | Kelly et al. |

(Continued)

FOREIGN PATENT DOCUMENTS

| | | | |
|---|---|---|---|
| CA | 2515558 | A1 | 2/2007 |
| CA | 2697029 | A1 | 2/2007 |

(Continued)

*Primary Examiner* — Brian Ensey
*Assistant Examiner* — Norman Yu
(74) *Attorney, Agent, or Firm* — TraskBritt

(57) ABSTRACT

A speaker comprises a support structure having a circumferentially extending rim, a vibration member configured to be displaced relative to the support structure during operation of the speaker, and a suspension member suspending the vibration member relative to the support structure. The suspension member includes a radially outer portion attached to the rim of the support structure, a radially inner platform portion attached to the vibration member, and a plurality of beams. Each beam of the plurality of beams may extend from the radially outer portion to the radially inner platform portion. The plurality of beams is configured such that a resonant frequency of the vibration member attached to the radially inner platform portion of the suspension member scales linearly with a beam width of the beams of the plurality of beams.

20 Claims, 10 Drawing Sheets

(56) References Cited

U.S. PATENT DOCUMENTS

| | | | | |
|---|---|---|---|---|
| D674,372 | S | 1/2013 | Kelly et al. | |
| D674,376 | S | 1/2013 | Kelly et al. | |
| D676,023 | S | 2/2013 | Kelly et al. | |
| D676,024 | S | 2/2013 | Kelly et al. | |
| D677,241 | S | 3/2013 | Kelly et al. | |
| D683,717 | S | 6/2013 | Kelly et al. | |
| D685,759 | S | 7/2013 | Kelly et al. | |
| D685,767 | S | 7/2013 | Kelly et al. | |
| D689,464 | S | 9/2013 | Bonahoom et al. | |
| D691,582 | S | 10/2013 | Nguyen et al. | |
| D693,793 | S | 11/2013 | Kelly et al. | |
| 8,594,362 | B2 * | 11/2013 | Liu | 381/396 |
| D699,216 | S | 2/2014 | Bonahoom et al. | |
| D701,193 | S | 3/2014 | Kelly et al. | |
| D701,196 | S | 3/2014 | Kelly et al. | |
| D701,197 | S | 3/2014 | Kelly et al. | |
| 2007/0142025 | A1 | 6/2007 | Alden | |
| 2008/0267440 | A1 | 10/2008 | Alden | |
| 2011/0075880 | A1 * | 3/2011 | Kamimura et al. | 381/413 |
| 2011/0164776 | A1 | 7/2011 | Kelly et al. | |
| 2011/0235819 | A1 | 9/2011 | Alden | |
| 2012/0128172 | A1 | 5/2012 | Alden | |
| 2012/0275615 | A1 | 11/2012 | Kelly et al. | |
| 2013/0118944 | A1 | 5/2013 | Niiro et al. | |
| 2013/0130540 | A1 | 5/2013 | Oman et al. | |
| 2013/0177165 | A1 | 7/2013 | Oishi | |
| 2013/0177195 | A1 | 7/2013 | Sze et al. | |
| 2013/0185905 | A1 | 7/2013 | Stiff et al. | |
| 2013/0208909 | A1 | 8/2013 | Mülder et al. | |
| 2013/0336514 | A1 | 12/2013 | Kelly et al. | |
| 2014/0056463 | A1 * | 2/2014 | Kim et al. | 381/398 |

FOREIGN PATENT DOCUMENTS

| | | |
|---|---|---|
| EP | 1760896 | 9/2010 |
| EP | 2262117 | 12/2010 |
| WO | 2010068495 | 6/2010 |
| WO | 2010124190 | 10/2010 |
| WO | 2011085096 | 7/2011 |
| WO | 2012024656 | 2/2012 |

* cited by examiner

SPEAKERS, HEADPHONES, AND KITS RELATED TO VIBRATIONS IN AN AUDIO SYSTEM, AND METHODS FOR FORMING SAME

CROSS-REFERENCE TO RELATED APPLICATION

This application claims the benefit of U.S. Provisional Patent Application Ser. No. 61/692,570, filed Aug. 23, 2012, entitled "Speakers, Headphones, and Kits Related to Vibrations in an Audio System, and Methods for Forming Same," the disclosure of which is hereby incorporated herein by this reference in its entirety.

FIELD

The disclosure relates generally to speaker devices. More specifically, disclosed embodiments relate to speaker devices that include a speaker configured to generate tactile vibrations that may be sensed by a person using the speaker, to headphones including such speakers, to kits that include such speakers, and to methods of making and using such speakers, headphones, and kits.

BACKGROUND

Conventional portable audio systems often include a headphone that is connected to a media player (e.g., by one or more wires or by wireless technology). Conventional headphones may include one or two speaker assemblies having an audio driver that produces audible sound waves with a diaphragm. For example, FIGS. 1 and 2 illustrate speaker assemblies 100 and 200, respectively, for a conventional headphone.

Referring to FIG. 1, the speaker assembly 100 may include a diaphragm 110 connected to a rim of a support structure 120. The diaphragm 110 may be a disk-shaped element configured to vibrate when a magnet or electromagnetic coil attached to the diaphragm 110 moves back and forth in a magnetic field responsive to an audio signal. As a result, the diaphragm 110 generates audible sound waves in the air proximate the speaker assembly 100 that correspond to the frequencies of the audio signals. The diaphragm 110 may comprise a relatively stiff plastic material. The diaphragm 110 may have a resonant frequency of approximately 90 Hz. Although the resonant frequency may be decreased by increasing the diameter of the diaphragm 110 or by reducing the thickness of the plastic material, it may be difficult or impractical to form a diaphragm 110 having a conventional design that exhibits a lower resonant frequency because the size of the diaphragm 110 would be too large, and/or the diaphragm 110 would be too thin and susceptible to damage.

Referring to FIG. 2, in additional previously known speaker systems, a speaker assembly 200 may include a metal suspension member 210 (instead of a plastic diaphragm) connected to a rim of a support structure 220. The suspension member 210 may be generally circular, and may have beams connecting a radially outer portion and a radially inner platform portion to which a magnet or electromagnetic coil may be attached. As described above, the suspension member 210 is displaced when the attached magnet or electromagnetic coil moves back and forth in a magnetic field in response to an audio signal. As a result, the suspension member 210 generates audible sound waves in the air proximate the speaker assembly 200 that correspond to the frequencies of the audio signals. As shown in FIG. 2, individual beams 212 extend in multiple directions and have corners where distinct transitions in direction are made.

DETAILED DESCRIPTION

In the following description, reference is made to the accompanying drawings in which is shown, by way of illustration, specific embodiments of the present disclosure. The embodiments are intended to describe aspects of the disclosure in sufficient detail to enable those skilled in the art to practice the invention. Other embodiments may be utilized and changes may be made without departing from the scope of the disclosure.

Disclosed embodiments relate generally to speakers, headphones, and related products and methods related to generating tactile vibrations in an audio system that may be felt by a person using the audio system. In particular, disclosed embodiments may include a speaker configured to vibrate responsive to an electronic audio signal. In some embodiments, the speaker may include a suspension member having a plurality of beams that are configured such that a resonant frequency of a vibration member (e.g., a magnet or an electromagnetic coil) attached to the suspension member scales linearly with a beam width of the beams of the plurality of beams.

A "speaker" is defined herein as an acoustic device configured to contribute to the generation of sound waves, such as with the reproduction of speech, music, or other audible sound. A speaker may also produce tactile vibrations that may be felt by a person. Thus, a speaker may include a tactile bass vibrator. A tactile bass vibrator may also be referred to as a transducer, a driver, a shaker, etc. While examples are given for speakers that are incorporated within headphones, incorporation within other devices is also contemplated.

A "bass frequency" is a relatively low audible frequency generally considered to be within the range extending from approximately 16 Hz to approximately 512 Hz. For purposes of this disclosure, a "low bass frequency" refers to bass frequencies that may be felt as well as heard. Such low bass frequencies may be within the range extending from approximately 16 Hz to approximately 200 Hz. The "peak bass frequency" of any particular media content is a bass frequency that exhibits a power peak when the media content is sampled. Further discussion regarding peak bass frequencies is provided below with respect to FIGS. 16 through 18.

Figure 3:
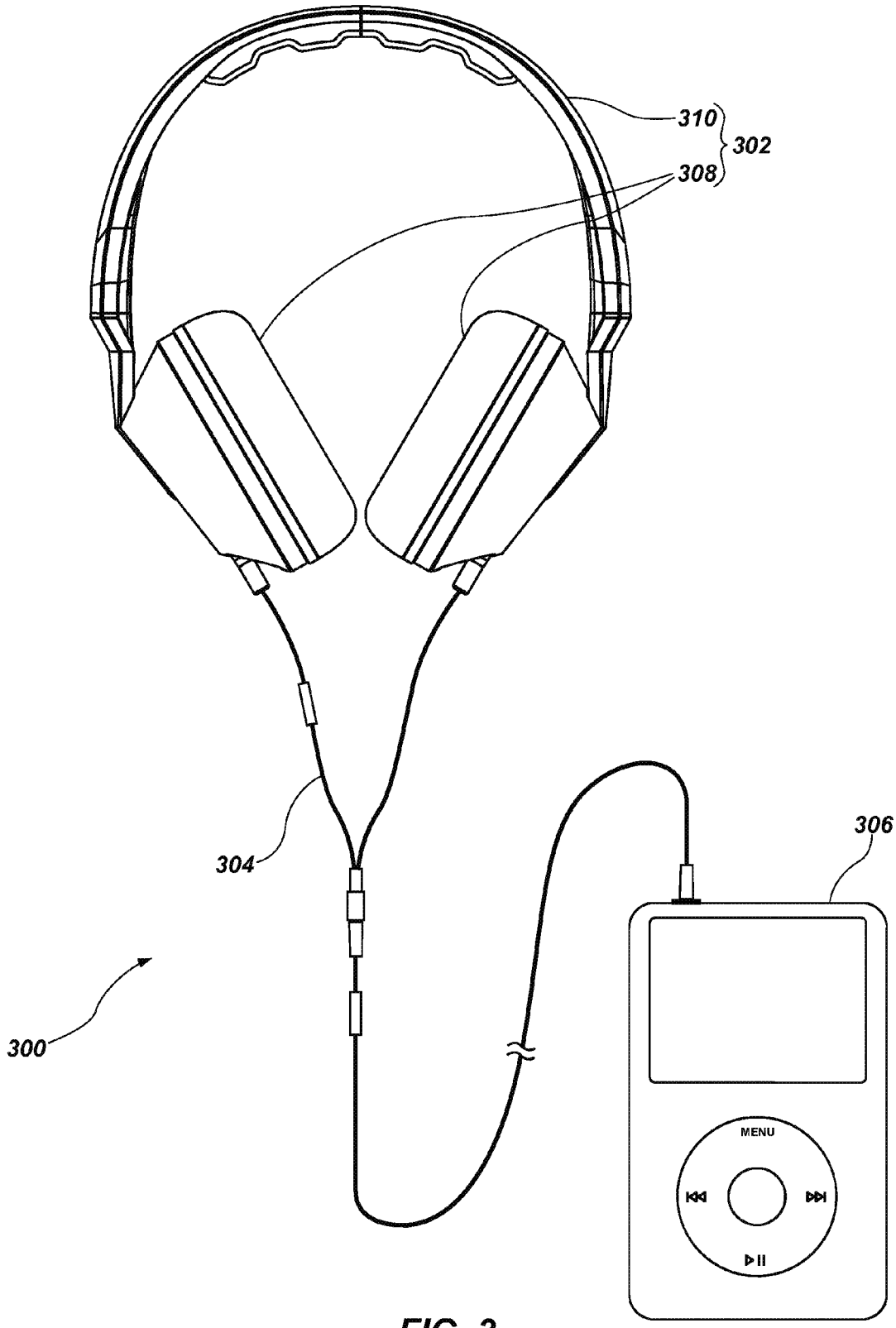
FIG. 3 is a simplified view of an embodiment of an audio system of the present disclosure.

FIG. 3 illustrates an embodiment of an audio system 300 of the present disclosure. The audio system 300 includes a headphone 302, a wiring system 304, and a media player 306. The headphone 302 is connected to the wiring system 304 such that audio signals carried by the wiring system 304 are transmitted to the headphone 302. The wiring system 304 is connected to the media player 306 such that audio signals produced by the media player 306 are transmitted through and carried by the wiring system 304. Thus, an audio signal from the media player 306 may be transmitted through the wiring system 304 to the headphone 302 where the audio signal is converted to audible sound. In additional embodiments, the audio system 300 may wirelessly transmit the audio signal to the headphone 302.

The headphone 302 may comprise two speaker assemblies 308 and a headband 310. The headband 310 may be configured to rest on a user's head, and to support the two speaker assemblies 308 when in use. The headband 310 may also be configured to position the two speaker assemblies 308 attached to the headband 310 proximate (e.g., on or over) a user's ears such that sound from the speaker assemblies 308 is heard by the user. In yet further embodiments, the headphone 302 may comprise ear bud speaker assemblies (which may or may not be carried on a headband 310), which may be inserted into the ears of the user.

The media player 306 may include any device or system capable of producing an audio signal and connectable to a speaker to convert the audio signal to audible sound. For example, the media player 306 may include portable digital music players, portable CD players, portable cassette players, mobile phones, smart phones, personal digital assistants (PDAs), eBook readers, portable gaming systems, portable DVD players, laptop computers, tablet computers, desktop computers, stereo systems, microphones, etc. As shown in FIG. 3, the media player 306 may comprise, for example, an IPOD® commercially available from Apple of Cuppertino, Calif.

The speaker assemblies 308 may be configured to convert the audio signal to audible sound and a tactile response (e.g., vibrations), as described in further detail hereinbelow.

Figure 4:
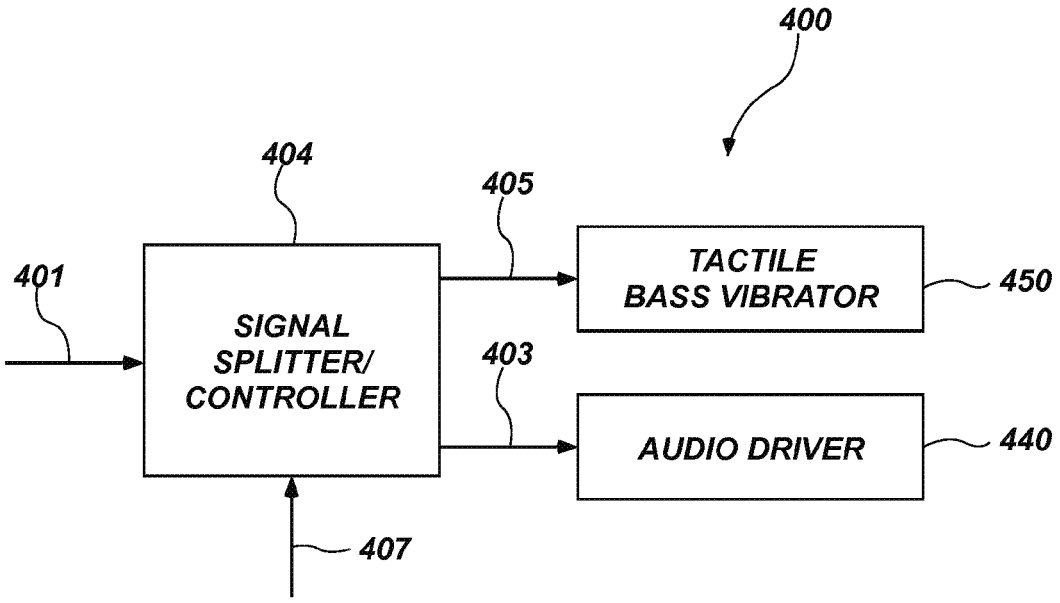
FIG. 4 is a simplified block diagram of a driver system according to an embodiment of the present disclosure.

FIG. 4 is a simplified block diagram of a driver system 400 according to an embodiment of the present disclosure. The driver system 400 may be included with the speaker assemblies 308 of FIG. 3 to convert an audio signal 401 to audible sound and a tactile response. The driver system 400 includes an audio driver 440 configured to emit sound at audible frequencies, and an additional, separate tactile bass vibrator 450 configured to emit low bass frequencies and to generate tactile vibrations within the speaker assemblies 308 that may be felt by the user. The driver system 400 may include a signal splitter/controller 404 configured to receive an audio signal 401 (e.g., from the media player 306 (FIG. 3)) and transmit a first split audio signal 403 to the audio driver 440 and a second split audio signal 405 to the tactile bass vibrator 450. The signal splitter 404 may include filters (e.g., low-pass, high-pass, etc.) such that the first split audio signal 403 includes medium to high frequencies (i.e., non-bass frequencies), while the second split audio signal 405 includes the bass frequencies. In some embodiments, at least some of the frequencies of the first split audio signal 403 and the second split audio signal 405 may at least partially overlap. For example, the audio driver 440 may be configured to emit some bass frequencies that are further enhanced by the tactile bass vibrator 450.

The signal splitter/controller 404 may further include control logic configured to modify the split audio signals 403, 405 responsive to a control signal 407. For example, the control signal 407 may control characteristics, such as volume. The signal splitter/controller 404 may be configured to control the first split audio signal 403 and the second split audio signal 405 independently. For example, a user may desire louder bass frequencies and a stronger tactile response at the bass frequencies. As a result, more power may be supplied to the tactile bass vibrator 450 relative to the power supplied to the audio driver 440.

Figure 5:
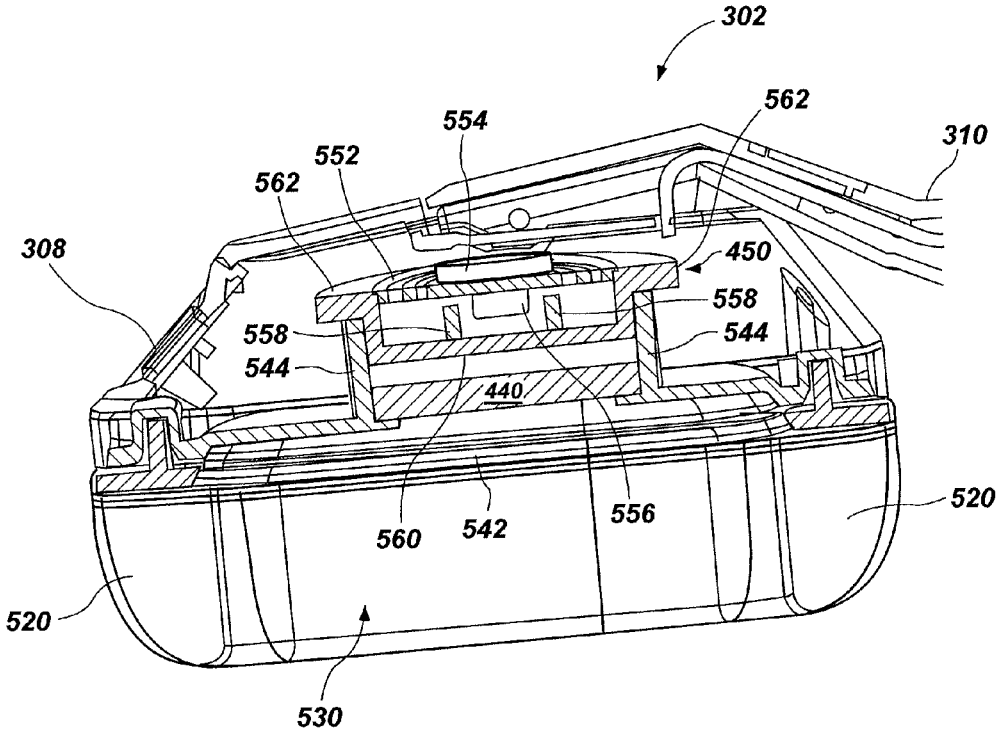
FIG. 5 is a cross-sectional side view of a portion of the headphone of FIG. 3.

FIG. 5 is a cross-sectional side view of a portion of the headphone 302 of FIG. 3. The headphone 302 may include the speaker assembly 308 connected to the headband 310. Although not shown in FIG. 5, the headphone 302 may include two such speaker assemblies 308 on opposing sides of the headband 310. The speaker assembly 308 may have an ear cup configuration configured to rest on or over the ear of the user. The speaker assembly 308 may include a cushion 520 and an air cavity 530 for comfort when worn over the ear of the user. The speaker assembly 308 may further include an audio driver 440 configured to emit sound at audible frequencies, and an additional, separate tactile bass vibrator 450 configured to emit low bass frequencies and to generate tactile vibrations within the speaker assembly 308 that may be felt by the user. In some embodiments, the speaker assembly 308 may further include a plate 542 positioned between the audio driver 440 and the air cavity 530.

The tactile bass vibrator 450 may be located within a housing of the speaker assembly 308. The tactile bass vibrator 450 may include a suspension member 552 configured for mounting a vibration member 556 thereon. The suspension member 552 may suspend the vibration member 556 on a radially inner platform portion of the suspension member 552. For example, the vibration member 556 may be attached to the underside of the suspension member 552. The suspension member 552 may further include a radially outer portion. Further detail regarding the suspension member 552 will be described below with regard to FIGS. 7 through 14.

The tactile bass vibrator 450 may further include a support structure 560 having a circumferentially extending rim 562. The radially outer portion of the suspension member 552 may be connected to the circumferentially extending rim 562, such as by a fastener, a snap fit, etc. In some embodiments, the suspension member 552 may be integrally formed with the support structure 560. The tactile bass vibrator 450 may further include one or more additional magnetic elements (e.g., coils 558). The coils 558 may be configured to generate a magnetic field responsive to an audio signal (e.g., second split audio signal 405 (FIG. 4)). The coils 558 may be connected to the support structure 560 within a cavity between the support structure 560 and the suspension member 552, such that the vibration member 556 may be within the magnetic field generated by the coils 558.

The support structure 560 and the suspension member 552 may be connected to a frame support member 544 of the speaker assembly 308, which may position the tactile bass vibrator 450 above the audio driver 440, or in other words, on a side of the audio driver 440 that is opposite the ear of a person using the headphone 302. In some embodiments, the suspension member 552 may be attached directly to the frame support member 544 such that the frame support member 544 is the support structure for the suspension member 552.

The vibration member 556 may be configured to be displaced relative to the support structure 560 during operation of the speaker assembly 308 for generating tactile vibrations within the speaker assembly 308 that may be felt by the user. The tactile bass vibrator 450 may exhibit a resonant frequency that is at least partially a function of the mass of the vibration member 556, as well as the configuration of the suspension member 552 and the composition of the material of the suspension member 552. In some embodiments, an additional weight 554 may be attached to the suspension member 552 to provide additional mass, which may increase the effect of the vibration and further contribute to the overall resonant frequency of the tactile bass vibrator 450.

In operation, the audio driver 440 may produce audible sound waves responsive to an input audio signal. The input audio signal 401 (FIG. 4) may be an audio signal received from a media player 306 (FIG. 3). The audio signal 401 transmitted by the media player 306 may be split and transmitted separately to each of the audio driver 440 and the tactile bass vibrator 450. (See FIG. 4). The tactile bass vibrator 450, however, may not be configured to generate audible high frequency sound. In some embodiments, medium and/or high frequencies may be filtered from the audio signal 401 prior to conveying the audio signal 401 to the tactile bass vibrator 450.

The coils 558 may receive the audio signal (e.g., second split audio signal 405) and generate a magnetic field in response to the current flowing through the coils 558. The magnetic field may vary based, at least in part, on the frequency of the audio signal. The vibration member 556 and the suspension member 552 may respond to the changing magnetic field by the vibration member 556 being displaced relative to the support structure 560. As a result, the vibration member 556 and the suspension member 552 may produce audible sound in the bass frequencies.

The tactile bass vibrator 450 may also cause vibrations within the speaker assembly 308 while the vibration member 556 is displaced. The tactile bass vibrator 450 may be oriented horizontally along with the plate 542. In other words, the vibrations of the tactile bass vibrator 450 may be at least substantially perpendicular to the plate 542. The vibrations caused from the displacement of the tactile bass vibrator 450 may cause the plate 542 to vibrate. While vibrating, the plate 542 may produce pressure waves in the air cavity 530, which may enhance the bass frequencies, and, in particular, having a peak at the resonant frequency of the tactile bass vibrator 450. The pressure waves and other physical vibrations in the headphone 302 may also be felt as vibrations to the user, which may further enhance the user's listening experience. Some modifications to the headphone 302 may affect the feel of the vibrations generated by the bass. For example, the size of the air cavity 530 may affect the strength of the vibrations. Forming apertures in the plate 542 may also have a similar effect as increasing the size of the air cavity 530, as the effective size of the air cavity 530 would be increased.

In some embodiments, the vibration member 556 may be configured to passively produce a magnetic field. For example, the vibration member 556 may comprise a physical magnet located within the active magnetic field generated by the coils. In another embodiment, the vibration member 556 may be configured to actively produce a magnetic field, such as including coils that receive the audio signal. In such an embodiment, the coils 558 may be replaced with a physical magnet fixedly attached to the support structure 560. As a result, as the magnetic field produced by the vibration member 556 changes, the presence of the physical magnet may cause the vibration member 556 (coils in this embodiment) to be displaced relative to the support structure 560.

Figure 6:
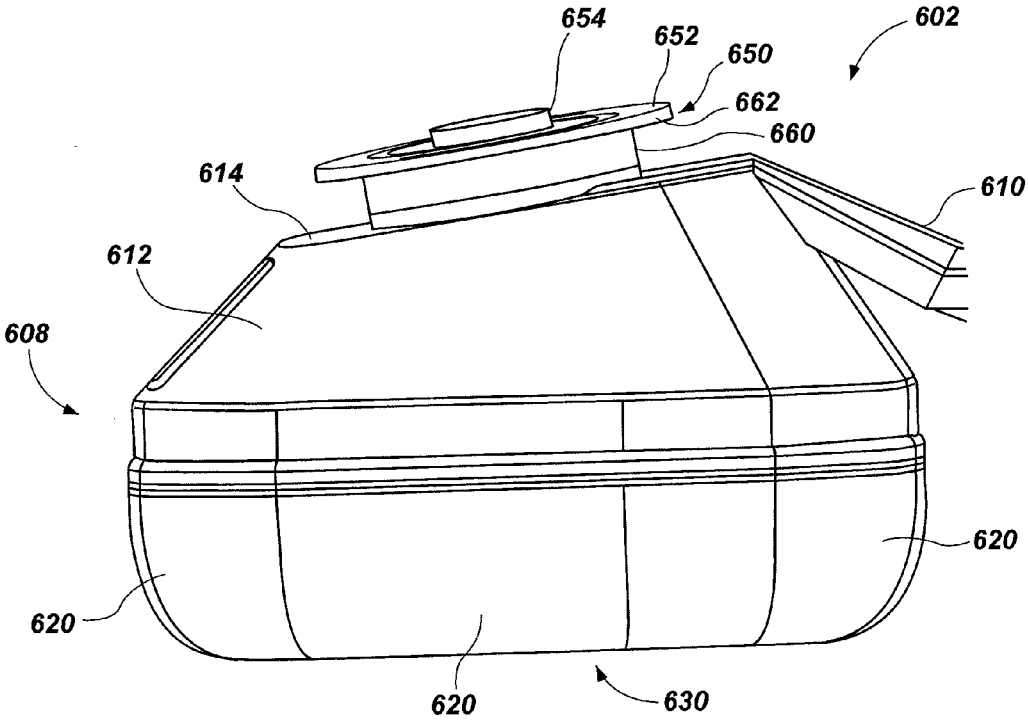
FIG. 6 is a side view of a portion of another embodiment of a headphone of the present disclosure.

FIG. 6 is a side view of a portion of a headphone 602 according to another embodiment of the present disclosure. The headphone 602 may be in an ear cup configuration, which may include a headband 610 connected to a speaker assembly 608. The speaker assembly 608 may include a cushion padding 620 and an air cavity 630 for comfort when worn over the ears of a user. The speaker assembly 608 may further include an audio driver (not shown) located within a housing 612 of the speaker assembly 608. The audio driver may be configured generally as discussed above.

The speaker assembly 608 may further include a tactile bass vibrator 650. The tactile bass vibrator 650 may be configured generally as discussed above. For example, the tactile bass vibrator 650 including a suspension member 652 configured for mounting a vibration member (not shown) thereon. The suspension member 652 may also have an additional optional weight 654 mounted thereon. The tactile bass vibrator 650 may further include a support structure 660 having a circumferentially extending rim 662. The vibration member (not shown) and additional optional weight 654 may be configured to be displaced relative to the support structure 660 during operation of the speaker assembly 608.

However, rather than being located within the housing 612 of the speaker assembly 608, the tactile bass vibrator 650 may be connected to an external surface of the speaker assembly 608. For example, the tactile bass vibrator 650 may be rigidly attached to a back surface 614 of the housing 612, or a portion of the headband 610 for generating low frequency vibrations that may be felt by the user. The tactile bass vibrator 650 may be connected at least substantially horizontal with a plate (not shown) connected with the housing 612 between the audio driver and the air cavity 630. As discussed above, if the audio signal received by the tactile bass vibrator 650 is at or near the resonant frequency of the tactile bass vibrator 650, the tactile bass vibrator 650 may cause vibrations in the plate that produce pressure waves and other vibrations that are felt by the user.

As discussed above, FIGS. 5 and 6 each show a single speaker assembly 308, 608 for each headphone 302, 602; however, it should be recognized that the headbands 310, 610 may be coupled to two such speaker assemblies 308, 608 (i.e., one for each ear). In some embodiments, each pair of speaker assemblies 308, 608 may be configured the same. For example, the resonant frequencies of each of the tactile bass vibrators 450, 650 may be the same for the right speaker assembly as well as the left speaker assembly. In some embodiments, however, the speaker assemblies of a headphone may have different components therein. For example, one of the speaker assemblies may include a battery for providing power thereto. As a result, the added weight of the battery may affect the resonant overall resonant frequency of the tactile base vibrator associated with that headphone. To compensate for such a difference in resonant frequencies, the tactile bass vibrator on one side of the headphone may be configured to exhibit a resonant frequency that is different than the tactile bass vibrator on the other side of the headphone. As a result, the overall effect of the resonant frequency for vibration of each of the speaker assemblies may be approximately the same.

In some embodiments, compensating for differences in components within each speaker assembly, different weights (e.g., weight 554 (FIG. 5)) may be attached to the suspension members of one or both of the speaker assemblies to alter the resonant frequency of one of the tactile bass vibrator such that the overall effect of the resonant frequencies for each speaker assembly is approximately the same. In some embodiments, a combination of different configurations of suspension members and different weights may be used.

Figure 20:
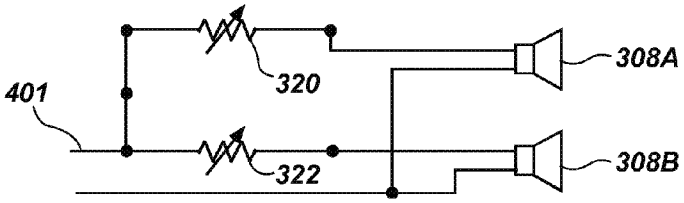
FIG. 20 shows a plurality of speakers assemblies configured for channel gain balancing.

In addition, different mechanical or electrical properties from each of the speaker assemblies may contribute to a non-uniform response for the audio driver 440, the tactile bass vibrator 450, or both. For example, if one speaker assembly weighs more than the other speaker assembly, the respective responses may be non-uniform. As another example, electrical performance of one or more drivers may be different due to tolerances within the drivers. To compensate for such differences in response, the channel gain for each speaker assembly may be balanced. For example, the audio signal to one speaker assembly may be amplified relative to the audio signal of the other speaker assembly. FIG. 20 shows a plurality of speakers assemblies 308A, 308B configured for channel gain balancing. The first speaker assembly 308A may be coupled to a first adjustable resistor 320, and the second speaker assembly 308B may be coupled to a second adjustable resistor 322 in the path of the audio signal 401 (e.g., from an amplifier). The resistor values of the first adjustable resistor 320 and the second adjustable resistor 322 may be adjusted by a controller until the response for the speaker assemblies 308A, 308B are approximately the same (i.e., balanced, uniform, etc.). In some embodiments, adjustable resistors may be coupled in the path of the split audio signals 403, 405 (FIG. 4) such that the channel gain of the audio driver 440 and tactile bass vibrator 450 may be adjusted separately.

Figure 7:
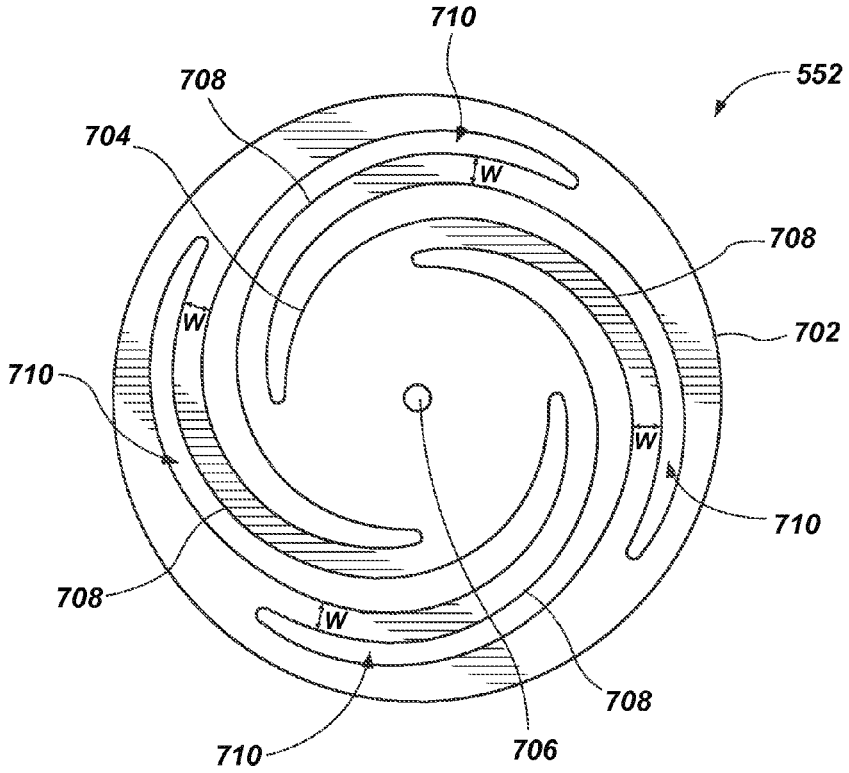
FIG. 7 is a top view of an embodiment of a suspension member for a tactile bass vibrator of FIG. 5.

FIG. 7 is a top plan view of the suspension member 552 for the tactile bass vibrator 450 of FIG. 5. The suspension member 552 may include a radially outer portion 702 and a radially inner platform portion 704. As discussed above, the radially outer portion 702 of the suspension member 552 may be attached to the rim 562 (FIG. 5) of the support structure 560 (FIG. 5), and the radially outer portion 702 may be attached to the vibration member 556 (FIG. 5). The vibration member 556 may be attached proximate a center 706 of the radially inner platform portion 704. Each of the radially outer portion 702 and the radially inner platform portion 704 may be generally circular. The center 706 of the radially inner platform portion 704 may also be substantially near the center of the circle defined by the radially outer portion 702. In other words, the radially outer portion 702 and the radially inner platform portion 704 may be concentric.

The radially outer portion 702 and the radially inner platform portion 704 may be connected to one another by a plurality of beams 708. The shape and dimensions of the beams 708 may affect the resonant frequency of the suspension member 552 with the vibration member 556 (FIG. 5) attached thereto. The plurality of beams 708 may be configured such that a resonant frequency of the vibration member 556 attached to the radially inner platform portion 704 of the suspension member 552 scales linearly with a beam width (w) of each beam 708 of the plurality of beams 708.

Figure 1:
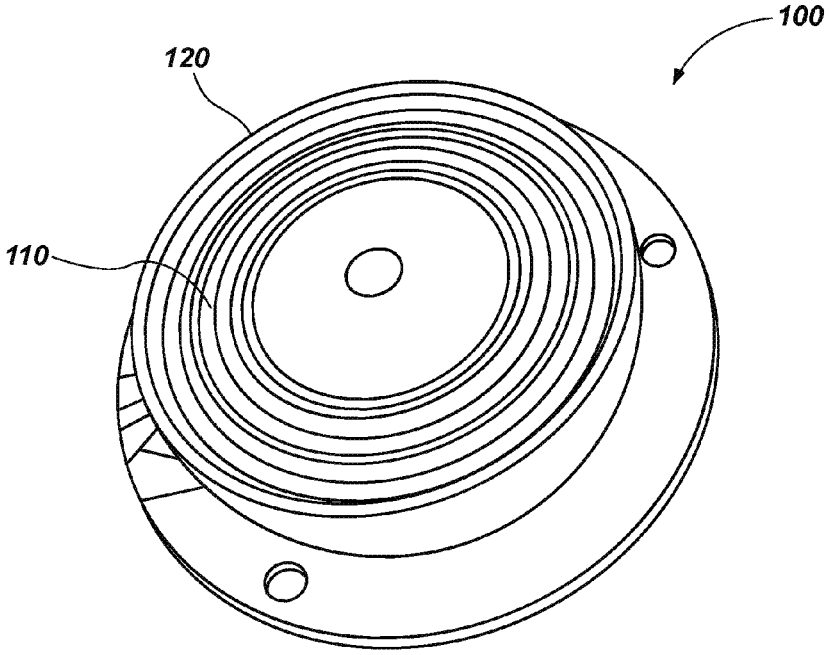
FIG. 1 illustrates a conventional speaker assembly for a headphone.
Figure 2:
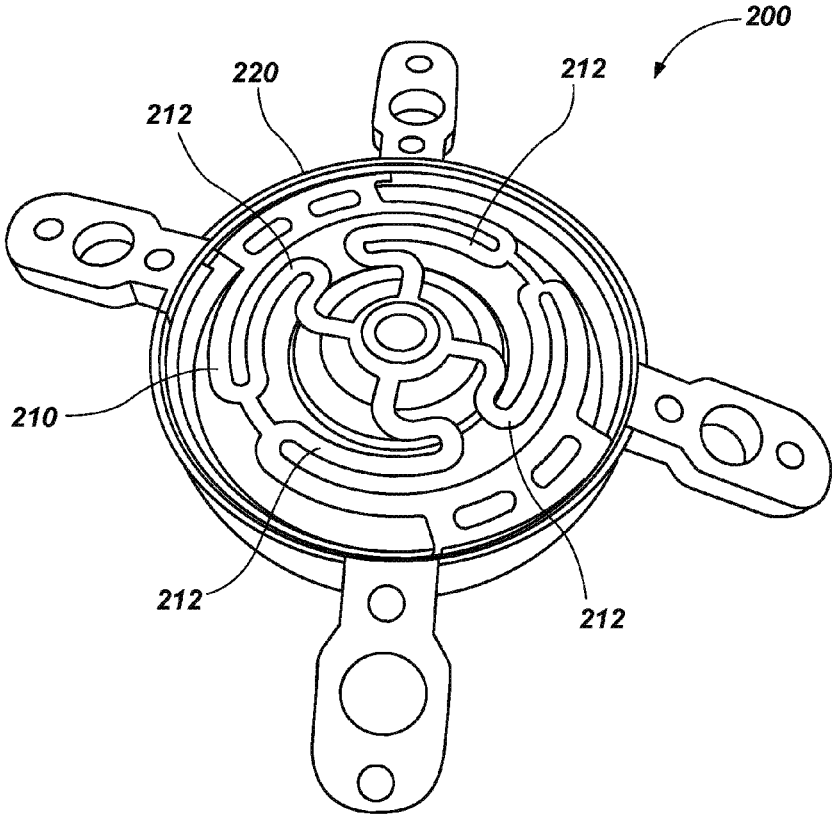
FIG. 2 illustrates another conventional speaker assembly for a headphone.

The beams 708 may be separated from each other by apertures 710 therebetween. Each beam 708 may contact the radially inner platform portion 704 at a respective single location, and each beam 708 may contact the radially outer portion 702 at a respective single location. Each beam 708 may not intersect or otherwise directly contact any of the other beams 708. In other words, each beam 708 connects one point of the radially outer portion 702 with one point of the radially inner platform portion 704. Each beam 708 may extend in a generally spiral direction from the radially outer portion 702 of the suspension member 552 to the radially inner platform portion 704. In some embodiments, each of the beams 708 may extend in a common spiral direction from the radially outer portion 702 of the suspension member 552 to the radially inner platform portion 704. For example, each of the beams 708 may extend in a counter-clockwise direction moving radially inward from the radially outer portion 702 to the radially inner platform portion 704 as shown in FIG. 7. In other embodiments, each of the beams 708 may extend in a clockwise direction moving radially inward from the radially outer portion 702 to the radially inner platform portion 704. In other words, the beams 708 may have a monotonic common spiral directionality, and may not bend to change direction, as in the conventional speaker assembly shown in FIG. 2. As a result, the beams 708 may extend smoothly and continuously in a common generally spiral direction between the radially outer portion 702 and the radially inner platform portion 704 without substantial corners (i.e., bends) or distinct transitions in the spiral direction. Doing so may reduce the stress concentrations and torsional stress along the beams 708, and may also result in the resonant frequency scaling linearly with the beam width (w).

In operation, a changing magnetic field responsive to the audio signal received by the tactile bass vibrator 450 may cause displacement of the vibration member 556 (FIG. 5) and the suspension member 552. As a result, the vibration member 556 may assist the suspension member 552 in vibrating. Vibration of the suspension member 552 may cause an increased bass response, as well as cause a tactile response (e.g., vibrations). Such a tactile response may be felt by a user, such that the user's listening experience may be enhanced. If the received audio signal is at the resonant frequency of the attached vibration member 556 and the suspension member 552, the speaker may resonate, which may result in an increased bass response and tactile response at that resonant frequency.

The suspension member 552 may be formed from a metal material, which may have a stiffness of the material that may affect the resonant frequency of the suspension member 552, as well as the deflection of the vibration member 556. For example, reducing the stiffness of the suspension member 552 may increase the deflection of the vibration member 556. Using a metal for the suspension member 552 may further permit lower resonance and therefore, a smaller casing, in comparison to other materials (e.g., plastic) that may be used. In addition, metal materials may be relatively strong and less likely to fatigue over time in comparison to some materials. Forming the suspension member 552 may include methods of forming and shaping a metal, such as laser cutting, press cutting, and other metal shaping and fabrication methods known in the art.

Figure 8:
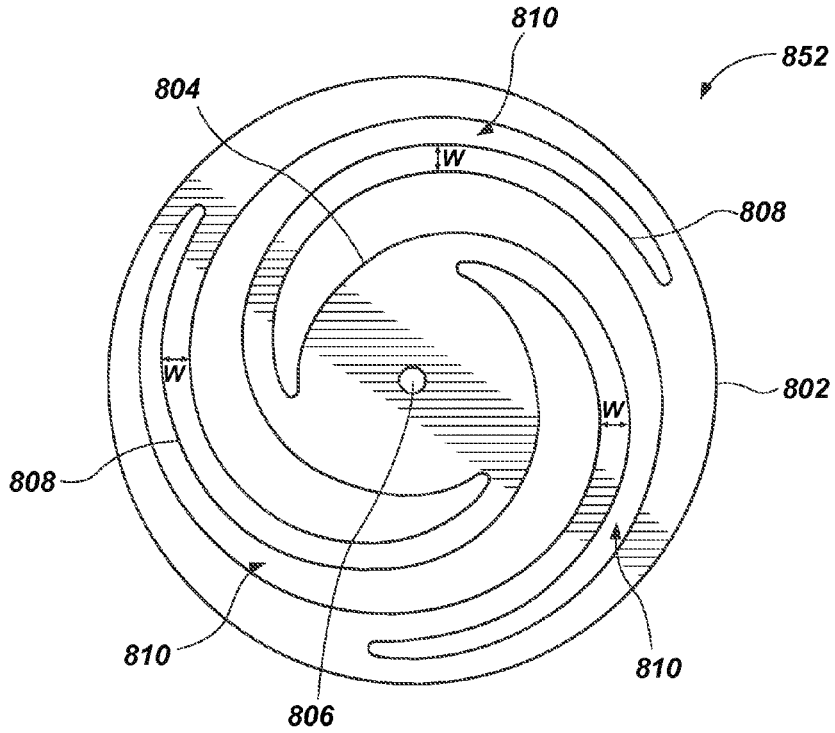
FIG. 8 is a top view of another embodiment of a suspension member for a speaker of the present disclosure.

FIG. 8 is a top view of a suspension member 852 for a speaker according to an embodiment of the present disclosure. The suspension member 852 may have a structure that scales linearly with beam width (w). The suspension member 852 includes radially outer portion 802 and a radially inner platform portion 804 for mounting a magnet (not shown)

proximate a center 806 of the radially inner platform portion 804. Each of the radially outer portion 802 and the radially inner platform portion 804 may be generally circular. The radially outer portion 802 and the radially inner platform portion 804 may be connected through a plurality of beams 808. The plurality of beams 808 may be separated from each other through a plurality of apertures 810 therebetween. The plurality of beams 808 may be configured similar to the plurality of beams 708 of FIG. 7. In particular, the plurality of beams 808 may be configured such that a resonant frequency of the vibration member attached to the radially inner platform portion 804 of the suspension member 852 scales linearly with a beam width (w) of each beam of the plurality of beams 808. In contrast with the suspension member 552 (FIG. 7) that included four beams 708, the suspension member 852 of FIG. 8 includes three beams 808. Some embodiments may include from two to five beams, although embodiments of the present disclosure may include any number of beams.

Figure 9:
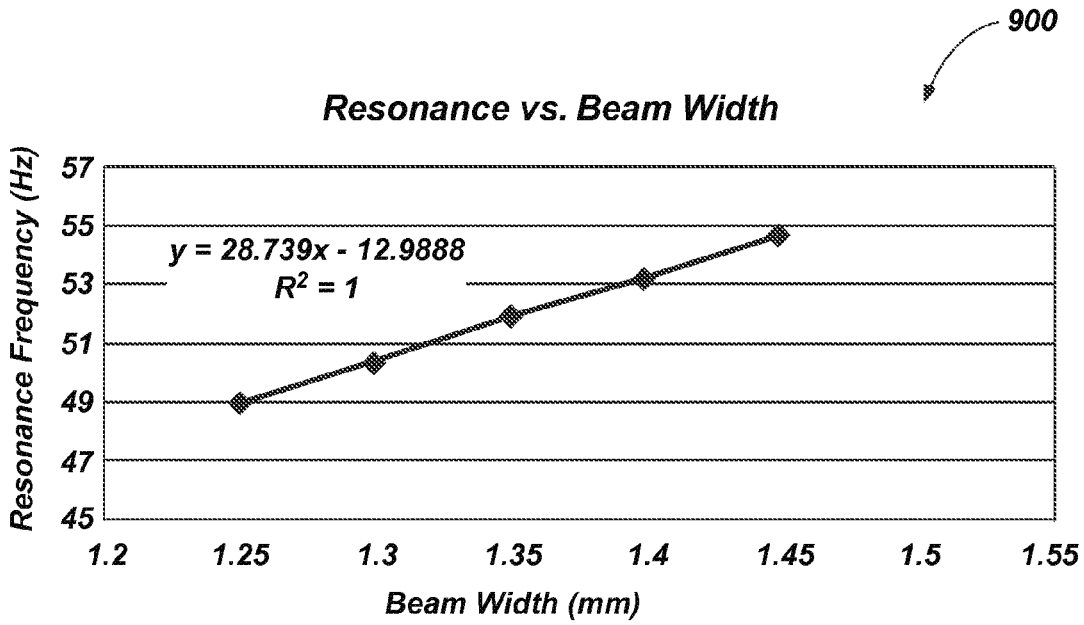
FIG. 9 is a graph showing resonant frequencies for different widths of beams of a suspension member as described herein.

FIG. 9 is a graph 900 showing resonant frequency (Hz) for a variety of beam widths (mm). In particular, the graph 900 shows that resonant frequency scales linearly with beam width (w). For example, the resonant frequency increases linearly as the beam widths increase.

Figure 10:
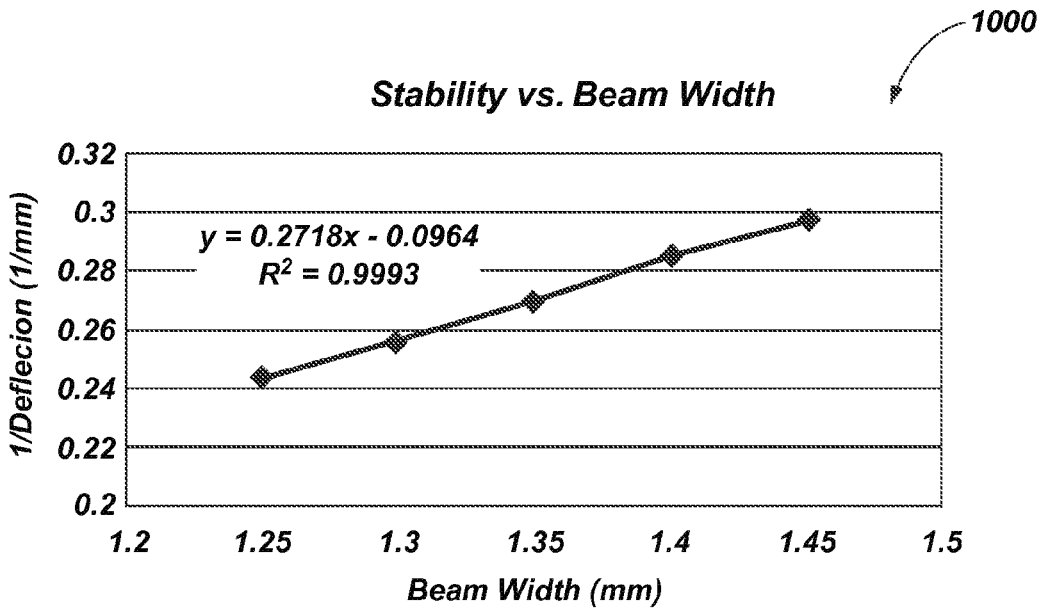
FIG. 10 is a graph showing stability of the suspension member of FIG. 9 for different widths of beams of the suspension member as described herein.

FIG. 10 is a graph 1000 showing stability of the suspension member (1/mm) for a variety of beam widths. Stability is defined as the reciprocal of the deflection (mm) of the magnet when the suspension member is resonating. According to embodiments of the present disclosure, as the beam widths increase, the stability may also improve.

Figure 11:
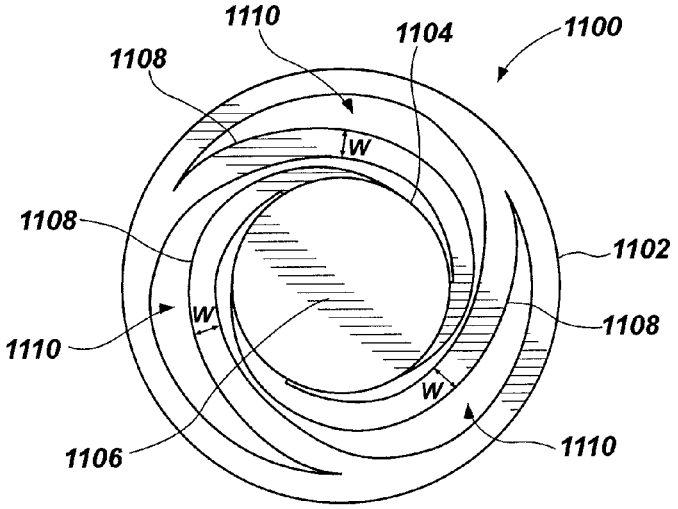
FIGS. 11, 12, and 13 are top plan views of additional embodiments of suspension members, which may be incorporated in headphone speakers.
Figure 12:
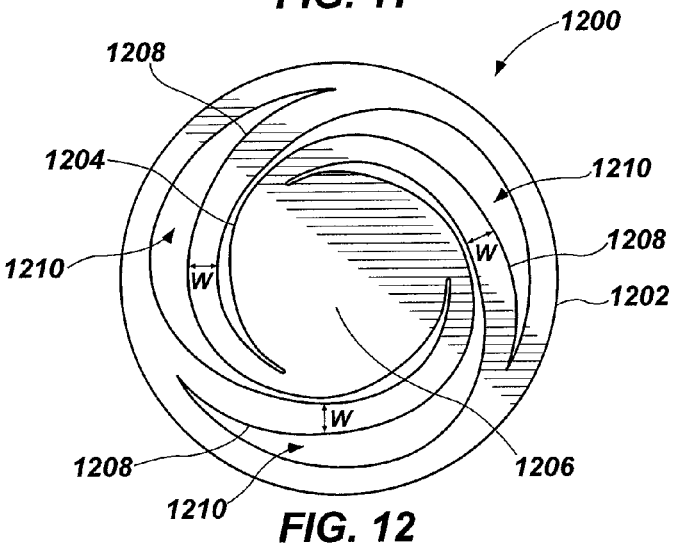
Figure 13:
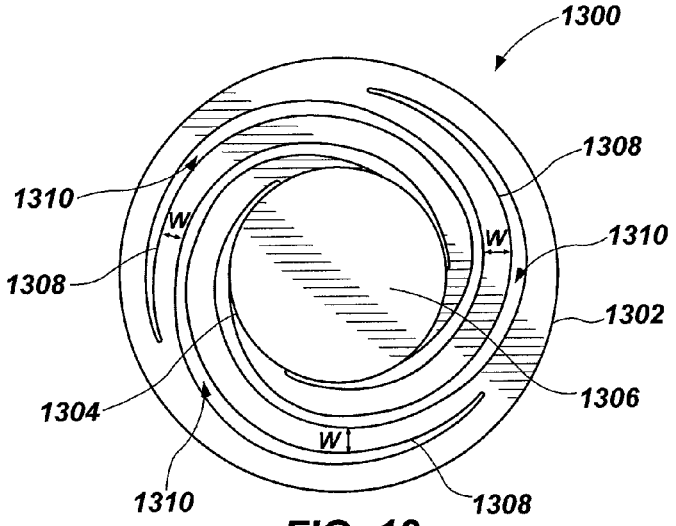

FIGS. 11, 12, and 13 are top views of suspension members 1100, 1200, and 1300, respectively, which may be incorporated with a speaker assembly of a headphone. Referring specifically to FIG. 10, the suspension member 1100 may include a radially outer portion 1102, and a radially inner platform portion 1104 for mounting a vibration member substantially near a center 1106 thereof. The radially outer portion 1102 and the radially inner platform portion 1104 may be connected together through a plurality of beams 1108 separated by apertures 1110. Referring specifically to FIG. 12, the suspension member 1200 may include a radially outer portion 1202, and a radially inner platform portion 1204 for mounting a vibration member substantially near a center 1206 thereof. The radially outer portion 1202 and the radially inner platform portion 1204 may be connected together through a plurality of beams 1208 separated by apertures 1210. Referring specifically to FIG. 13, the suspension member 1300 may include a radially outer portion 1302, and a radially inner platform portion 1304 for mounting a vibration member substantially near a center 1306 thereof. The radially outer portion 1302 and the radially inner platform portion 1304 may be connected together through a plurality of beams 1308 separated by apertures 1310.

Referring again collectively to FIGS. 11, 12, 13, the suspension members 1100, 1200, 1300 may be configured to exhibit a particular resonant frequency (in the assembled state within the tactile bass vibrators). The resonant frequencies of the suspension members 1100, 1200, 1300, may be scaled according to the width of the respective beams 1108, 1208, 1308, which scaling may be linear with beam width (w). For example, the beams 1108 may be narrower than the beams 1208, which may be narrower than the beams 1308. As an example, the resonant frequency (e.g., 83 Hz) of the suspension member 1100 may be greater than the resonant frequency (e.g., 65 Hz) of the suspension member 1200, which may be greater than the resonant frequency (e.g., 56 Hz) of the suspension member 1300.

In operation, a changing magnetic field responsive to the audio signal received by the tactile bass vibrator 450 (FIG. 5) may cause displacement of the vibration member 556 (FIG. 5) and the suspension members 1100, 1200, 1300. As a result, the vibration member 556 may assist the suspension members 1100, 1200, 1300 in vibrating. Vibration of the suspension members 1100, 1200, 1300 may cause an increased bass response, as well as cause a tactile response (e.g., vibrations). Such a tactile response may be felt by the user, such that the user's listening experience may be enhanced. If the received audio signal is at the resonant frequency of the attached vibration member 556 and the suspension members 1100, 1200, 1300 the speaker may resonate, which may result in an increased bass response and tactile response at that resonant frequency. Having a design that scales the resonant frequency linearly for a dimension of the beams 1108, 1208, 1308 may provide methods for tuning the resonant frequency in a predictable manner so that time and money are not wasted producing speakers that do not adequately meet desired requirements.

Figure 14:
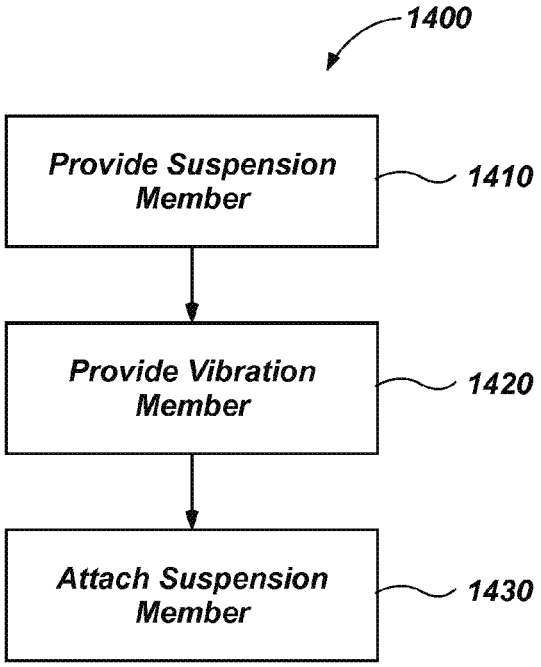
FIG. 14 is a flowchart for a method of forming a speaker.

FIG. 14 is a flowchart 1400 for a method of forming a speaker. At operation 1410, a suspension member may be provided. The suspension member may include a radially outer portion, a radially inner platform portion, and a plurality of beams. Each beam of the plurality of beams may extend from the radially outer portion to the radially inner platform portion. The beams of the plurality of beams may be configured such that a resonant frequency of a vibration member attached to the radially inner platform portion of the suspension member scales linearly with a beam width (w) of the beams of the plurality of beams. The suspension member may also be selected to comprise a metal suspension member.

At operation 1420, a vibration member may be provided. The vibration member may be attached to the radially inner platform portion of the suspension member. The vibration member may be selected to comprise a physical magnet that is configured to be displaced with the suspension member relative one or more coils that actively generate a magnetic field responsive to an audio signal. The coils may be fixedly attached to a support structure. In some embodiments, the vibration member may be selected to comprise a coil configured to actively generate a magnetic field responsive to the audio signal, wherein the magnetic object is a physical magnet fixedly attached to the support structure. As a result, the vibration member (including one or more coils) is displaced with the suspension member.

At operation 1430, the suspension member may be attached to the support structure. In particular, the radially outer portion of the suspension member may be attached to a rim of the support member such that the vibration member is suspended relative to the support member.

Figure 15:
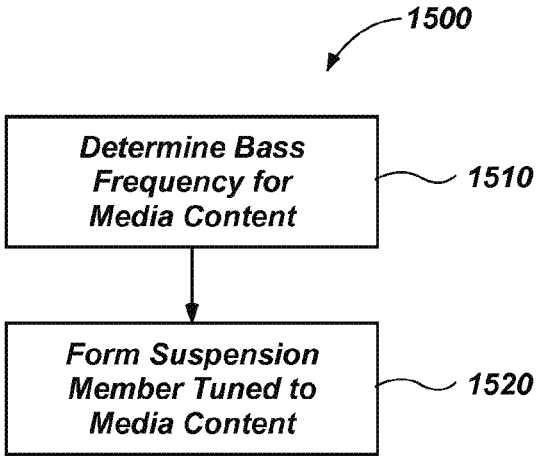
FIG. 15 is a flowchart for another method of forming a speaker.

FIG. 15 is a flowchart 1500 for a method of forming a speaker. In particular, the method may include forming the speaker to have a resonant frequency tuned to a specific media content. At operation 1510, a bass frequency of the media content may be determined. The bass frequency may be determined by sampling an electrical audio signal for a media device having media content stored thereon. Media content may include a movie, music, a video game, and other media content that includes audio content. A spectrum analysis of the sampled audio content may also be performed. The bass frequency of interest may be the peak bass frequency of the media content.

At operation 1520, a suspension member may be formed that is tuned to the media content, such as to a bass frequency of interest (e.g., peak bass frequency of the media content). For example, the suspension member may be formed from a metal material to include a plurality of beams that curve in a single general direction around the suspension member connecting a radially outer portion and a radially inner platform portion. The dimensions of the beams may be configured to tune the speaker to exhibit a resonant frequency that is approximately the peak bass frequency of the media content of the media device.

The shape of the beams may be smooth and continuous, and may scale linearly with the resonant frequency. For example, the plurality of beams may be configured such that the resonant frequency of the vibration member attached to the radially inner platform portion of the suspension member is between approximately 40 Hz and approximately 60 Hz.

In some embodiments, each beam of the plurality of beams may be formed to extend in a spiral direction from the radially outer portion of the suspension member to the radially inner platform portion. In some embodiments, each beam of the plurality of beams may be formed to extend in a common spiral direction from the radially outer portion of the suspension member to the radially inner platform portion. In some embodiments, each beam of the plurality of beams may be formed to extend continuously without bends in the spiral direction from the radially outer portion of the suspension member to the radially inner platform portion. In some embodiments, the beams of the plurality of beams may be located such that they do not intersect one another.

The suspension member may then be provided and attached to a vibration member and a rim of a support member to form a speaker as discussed above with respect to FIG. 14. The speaker may also be packaged with a media storage device that includes the media content to which the speaker is tuned. For example, the speaker and media storage device may be packaged in a common package for sale or distribution, such as, for example, as a kit.

Figure 16:
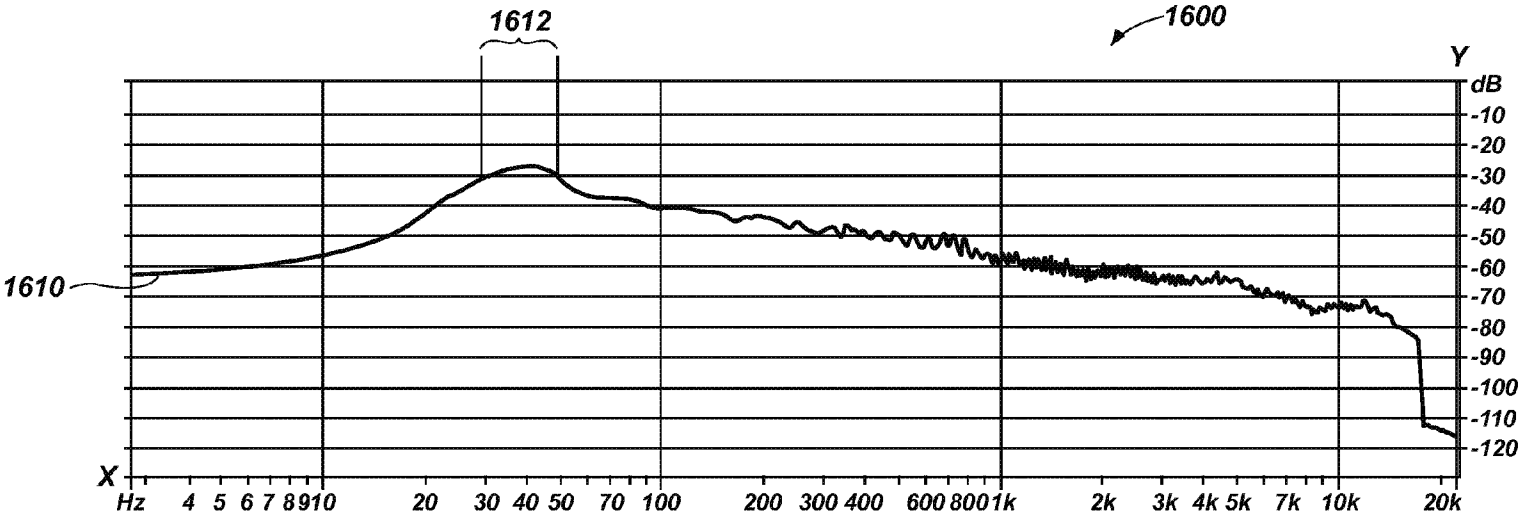
FIGS. 16, 17, and 18 are graphs showing a spectral analysis of different media content.

FIG. 16 is a graph 1600 showing a spectral analysis of a media content. For example, the media content may be a video game, such as "Mass Effect 3." In the graph 1600, the frequencies (in Hz) present in a sampled audio signal 1610 are measured along the X-axis, and the signal power (in dB) of the sampled audio signal 1610 are measured along the Y-axis. As discussed above, the bass frequencies include relatively low audible frequencies in the range of approximately 16 Hz and approximately 200 Hz. As shown in FIG. 16, the sampled audio signal 1610 for the media content has a peak bass frequency 1612 (i.e., a frequency within the bass frequencies at which a power peak is determined, or any frequency within a range of frequencies when a power peak extends over a range of frequencies). For example, in FIG. 16, the peak bass frequency may be a frequency in the range of approximately 30 Hz to approximately 50 Hz. As a result, the speaker may be considered to be tuned to the media content if the resonant frequency of the speaker is any frequency within the range of approximately 30 Hz to approximately 50 Hz.

Figure 17:
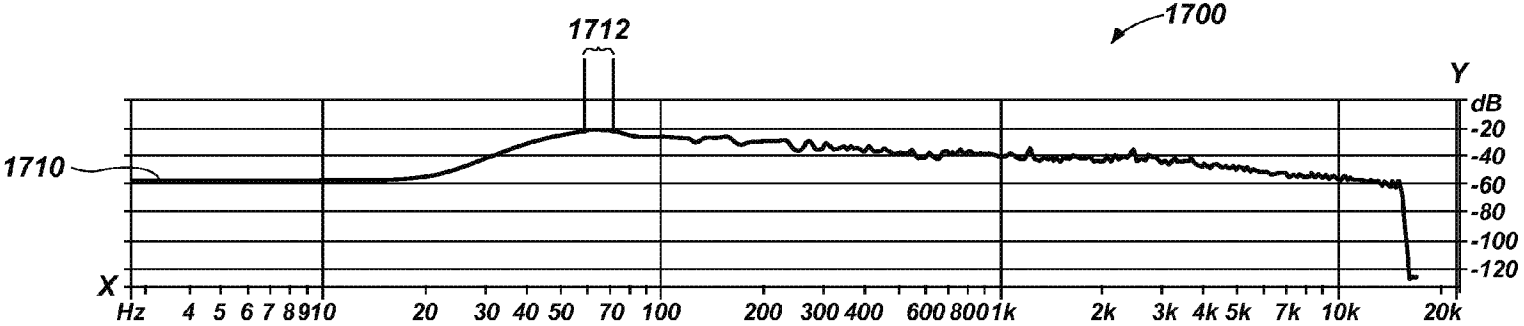

FIG. 17 is a graph 1700 showing a spectral analysis of a media content. For example, the media content may be music, such as the song "Take the Power Back" by the group "Rage Against the Machine." In the graph 1700, the frequencies (in Hz) present in a sampled audio signal 1710 are measured along the X-axis, and the power (in dB) of the sampled audio signal 1710 are measured along the Y-axis. As shown in FIG. 17, the sampled audio signal 1710 for the media content has a peak bass frequency 1712 within the range of approximately 60 Hz to approximately 70 Hz. As a result, the speaker may be considered to be tuned to the media content if the resonant frequency of the speaker is any frequency within the range of approximately 60 Hz to approximately 70 Hz.

Figure 18:
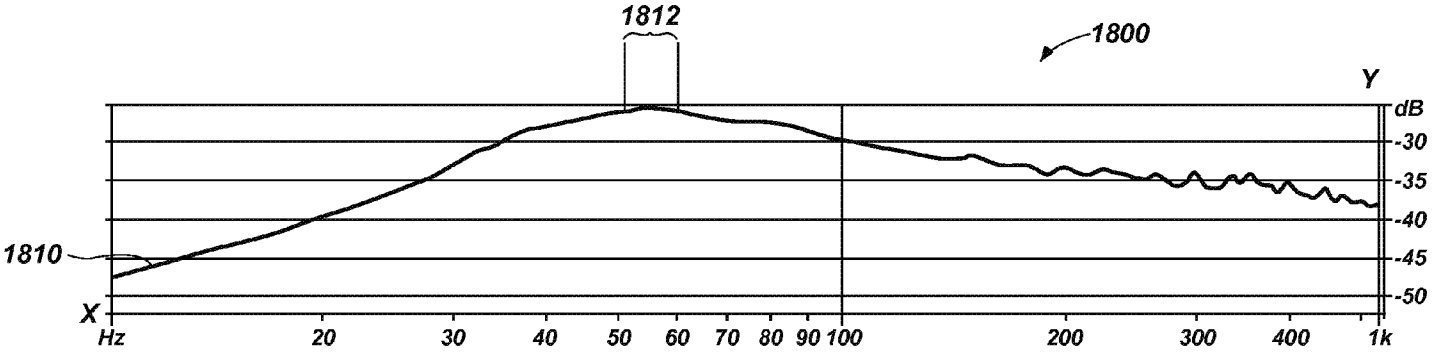

FIG. 18 is a graph 1800 showing a spectral analysis of a media content. For example, the media content may be a movie, such as the movie "Transformers 3." In the graph 1800, the frequencies (in Hz) present in a sampled audio signal 1810 are measured along the X-axis, and the power (in dB) of the sampled audio signal 1810 are measured along the Y-axis. As shown in FIG. 18, the sampled audio signal 1810 for the media content has a peak bass frequency 1812 within the range of approximately 50 Hz to approximately 60 Hz. As a result, the speaker may be considered to be tuned to the media content if the speaker is configured to exhibit a resonant frequency of the speaker is any frequency within the range of approximately 50 Hz to approximately 60 Hz.

Figure 19:
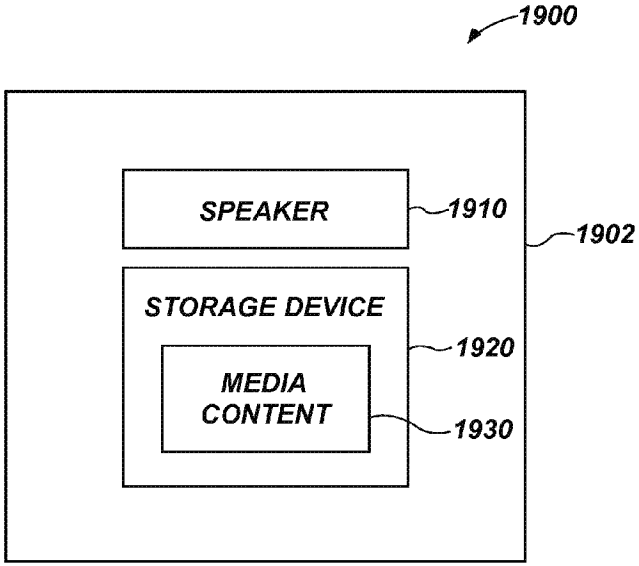
FIG. 19 is a simplified block diagram illustrating an embodiment of a kit of the present disclosure that includes at least one speaker as described herein and a media storage device storing media thereon.

FIG. 19 is a kit 1900 that includes at least one speaker 1910 and a storage device 1920. The storage device may store media content 1930 that is configured to generate an audio signal, such as when played by a media player. The at least one speaker 1910 may be configured generally as described above. For example, the at least one speaker may include a support member having a circumferentially extending rim, a vibration member configured to be displaced relative to the support structure responsive to receipt of the electrical audio signal when sent to the at least one speaker by a media player playing the media content, and a suspension member suspending the vibration member relative to the support member. The suspension member may include a radially outer portion attached to the rim of the support member and a radially inner platform portion attached to the vibration member. The suspension member may further include a plurality of beams, each beam of the plurality of beams extending from the radially outer portion to the radially inner platform portion. The beams of the plurality of beams may be configured such that a resonant frequency of the vibration member attached to the radially inner platform portion of the suspension member is at least approximately equal to a peak bass frequency of the electrical audio signal. In other words, the resonant frequency of a tactile bass vibrator (i.e., speaker 1910) may be tuned to audio characteristics of a particular media content 1930.

The storage device 1920 including the media content 1930 may be packaged and sold with the at least one speaker 1910 in a common package 1902. The at least one speaker 1910 may be included within a headphone. The storage device 1920 may include any type of computer-readable storage media, such as, for example, a compact disc (CD), a digital video disc (DVD), a BLU-RAY DISC®, a Flash memory device, a gaming device, and other types of memory devices for storing information. The media content 1930 may include, for example, music, a movie, and a video game.

Additional non-limiting example Embodiments are described below.

Embodiment 1

A speaker, comprising: a support structure having a circumferentially extending rim; a vibration member configured to be displaced relative to the support structure during operation of the speaker for generating vibrations; and a suspension member suspending the vibration member relative to the support structure, the suspension member including: a radially outer portion attached to the rim of the support structure; a radially inner platform portion attached to the vibration member; and a plurality of beams, each beam of the plurality of beams extending from the radially outer portion to the radially inner platform portion, wherein the plurality of beams is configured such that a resonant frequency of the vibration member attached to the radially inner platform portion of the suspension member scales linearly with a beam width of the beams of the plurality of beams.

Embodiment 2

The speaker of Embodiment 1, wherein the beams of the plurality of beams are configured such that the resonant frequency of the vibration member attached to the radially inner platform portion of the suspension member is between approximately 40 Hz and approximately 60 Hz.

Embodiment 3

The speaker of Embodiment 1 or Embodiment 2, wherein the vibration member comprises a physical magnet.

Embodiment 4

The speaker of any of Embodiments 1 through 3, wherein the vibration member comprises an electrical coil configured to generate a magnetic field responsive to an audio signal.

Embodiment 5

The speaker of any of Embodiments 1 through 4, wherein the suspension member comprises a metal suspension member.

Embodiment 6

The speaker of any of Embodiments 1 through 5, wherein each beam of the plurality of beams extends in a spiral direction from the radially outer portion of the suspension member to the radially inner platform portion.

Embodiment 7

The speaker of Embodiment 6, wherein each beam of the plurality of beams extends in a common spiral direction from the radially outer portion of the suspension member to the radially inner platform portion.

Embodiment 8

The speaker of Embodiment 6, wherein each beam of the plurality of beams extends continuously without bends in the spiral direction from the radially outer portion of the suspension member to the radially inner platform portion.

Embodiment 9

The speaker of any of Embodiments 1 through 8, wherein the plurality of beams comprises from two to five beams.

Embodiment 10

The speaker of any of Embodiments 1 through 9, wherein the beams do not intersect one another.

Embodiment 11

A speaker, comprising: a support structure having a circumferentially extending rim; a vibration member configured to be displaced within the support structure for generating vibrations during operation of the speaker; and a suspension member suspending the vibration member relative to the support structure, the suspension member including a radially outer portion attached to the rim of the support structure and a radially inner platform portion attached to the vibration member, the suspension member further including a plurality of beams, each beam of the plurality of beams extending from the radially outer portion to the radially inner platform portion, wherein each beam of the plurality of beams extends in a spiral direction from the radially outer portion of the suspension member to the radially inner platform portion.

Embodiment 12

The speaker of Embodiment 11, wherein the suspension member comprises a metal suspension member.

Embodiment 13

The speaker of Embodiment 11 or Embodiment 12, wherein each beam of the plurality of beams extends in a common spiral direction from the radially outer portion of the suspension member to the radially inner platform portion.

Embodiment 14

The speaker of any of Embodiments 11 through 13, wherein each beam of the plurality of beams extends continuously without bends in the spiral direction from the radially outer portion of the suspension member to the radially inner platform portion.

Embodiment 15

The speaker of any of Embodiments 11 through 14, wherein the beams do not intersect one another.

Embodiment 16

A headphone including at least one speaker and a device for operatively coupling the at least one speaker with a media player configured to send an electrical audio signal to the at least one speaker, the at least one speaker comprising: a support structure having a circumferentially extending rim; a vibration member configured to be displaced within the support structure and generate vibrations responsive to receipt of the electrical audio signal sent to the at least one speaker by the media player; and a suspension member suspending the vibration member relative to the support structure, the suspension member including a radially outer portion attached to the rim of the support structure and a radially inner platform portion attached to the vibration member, the suspension member further including a plurality of beams, each beam of the plurality of beams extending from the radially outer portion to the radially inner platform portion, wherein the beams of the plurality of beams are configured such that a resonant frequency of the vibration member attached to the radially inner platform portion of the suspension member scales linearly with a beam width of the beams of the plurality of beams.

Embodiment 17

The headphone of Embodiment 16, further comprising a headband, the at least one speaker attached to the headband.

Embodiment 18

The headphone of Embodiment 16, wherein the at least one speaker comprises an ear bud speaker configured to fit within an ear of a person using the headphone.

Embodiment 19

The headphone of Embodiment 16, wherein the at least one speaker further comprises: a housing; and a cushion attached to the housing and configured to be disposed on or over an ear of a person using the headphone.

Embodiment 20

A method of forming a speaker, the method comprising: providing a suspension member including a radially outer portion, a radially inner platform portion, and a plurality of beams, each beam of the plurality of beams extending from the radially outer portion to the radially inner platform portion, the beams of the plurality of beams configured such that a resonant frequency of a vibration member attached to the radially inner platform portion of the suspension member scales linearly with a beam width of the beams of the plurality of beams; attaching the vibration member to the radially inner platform portion of the suspension member; and attaching the radially outer portion of the suspension member to a rim of a support structure such that the vibration member is suspended relative to the support structure.

Embodiment 21

The method of Embodiment 20, further comprising selecting the vibration member to comprise a physical magnet.

Embodiment 22

The method of Embodiment 20 or Embodiment 21, further comprising selecting the suspension member to comprise a metal suspension member.

Embodiment 23

The method of any of Embodiments 20 through 22, further comprising forming the suspension member.

Embodiment 24

The method of Embodiment 23, wherein forming the suspension member comprises configuring the beams of the plurality of beams such that the resonant frequency of the vibration member attached to the radially inner platform portion of the suspension member is between approximately 40 Hz and approximately 60 Hz.

Embodiment 25

The method of Embodiment 23 or Embodiment 24, wherein forming the suspension member comprises forming each beam of the plurality of beams to extend in a spiral direction from the radially outer portion of the suspension member to the radially inner platform portion.

Embodiment 26

The method of Embodiment 25, wherein forming the suspension member further comprises forming each beam of the plurality of beams to extend in a common spiral direction from the radially outer portion of the suspension member to the radially inner platform portion.

Embodiment 27

The method of any of Embodiments 23 through 26, wherein forming the suspension member comprises forming each beam of the plurality of beams to extend continuously without bends in the spiral direction from the radially outer portion of the suspension member to the radially inner platform portion.

Embodiment 28

The method of any of Embodiments 23 through 27, wherein forming the suspension member comprises locating and configuring the beams of the plurality of beams such that they do not intersect one another.

Embodiment 29

The method of any of Embodiments 23 through 28, wherein forming the suspension member comprises forming a metal suspension member.

Embodiment 30

The method of any of Embodiments 20 through 29, further comprising: sampling an electrical audio signal for a media device; determining a peak bass frequency of the electrical audio signal; and configuring the beams of the plurality of beams of the suspension member such that the resonant frequency of the vibration member attached to the radially inner platform portion of the suspension member is at least approximately equal to the peak bass frequency of the electrical audio signal of the media device.

Embodiment 31

The method of Embodiment 30, further comprising packaging the speaker and the media device in a common package for sale or distribution.

Embodiment 32

A kit including at least one speaker and a storage device storing media content configured to generate an electrical audio signal, wherein the at least one speaker comprises: a support structure having a circumferentially extending rim; a vibration member configured to be displaced within the support structure for generating vibrations responsive to receipt of the electrical audio signal when sent to the at least one speaker by a media player playing the media content; and a suspension member suspending the vibration member relative to the support structure, the suspension member including a radially outer portion attached to the rim of the support structure and a radially inner platform portion attached to the vibration member, the suspension member further including a plurality of beams, each beam of the plurality of beams extending from the radially outer portion to the radially inner platform portion, wherein the beams of the plurality of beams are configured such that a resonant frequency of the vibration member attached to the radially inner platform portion of the suspension member is at least approximately equal to a peak bass frequency of the electrical audio signal.

Embodiment 33

The kit of Embodiment 32, wherein the media content is selected from the group consisting of music, a movie, and a video game.

While certain illustrative embodiments have been described in connection with the figures, those of ordinary skill in the art will recognize and appreciate that embodiments of the invention are not limited to those embodiments explicitly shown and described herein. Rather, many additions, deletions, and modifications to the embodiments described herein may be made without departing from the scope of embodiments of the invention as hereinafter claimed, including legal equivalents. In addition, features from one embodiment may be combined with features of another embodiment while still being encompassed within the scope of embodiments of the invention as contemplated by the inventors.

What is claimed is:

1. An apparatus, comprising:

a speaker, including:

a support structure having a circumferentially extending rim;

a vibration member configured to be displaced relative to the support structure during operation of the speaker for generating vibrations; and a suspension member suspending the vibration member relative to the support structure, the suspension member including:

a radially outer portion attached to the rim of the support structure;

a radially inner platform portion attached to the vibration member; and a plurality of beams, each beam of the plurality of beams extending from the radially outer portion to the radially inner platform portion, wherein the plurality of beams is configured such that a resonant frequency of the vibration member attached to the radially inner platform portion of the suspension member scales linearly with a beam width of the beams of the plurality of beams.

2. The apparatus of claim 1, wherein the beams of the plurality of beams are configured such that the resonant frequency of the vibration member attached to the radially inner platform portion of the suspension member is between approximately 40 Hz and approximately 60 Hz.

3. The apparatus of claim 1, wherein the vibration member comprises at least one of a physical magnet and an electrical coil configured to generate a magnetic field responsive to an audio signal.

4. The apparatus of claim 1, wherein the suspension member comprises a metal suspension member.

5. The apparatus of claim 1, wherein each beam of the plurality of beams extends in a spiral direction from the radially outer portion of the suspension member to the radially inner platform portion.

6. The apparatus of claim 5, wherein each beam of the plurality of beams extends in a common spiral direction from the radially outer portion of the suspension member to the radially inner platform portion.

7. The apparatus of claim 5, wherein each beam of the plurality of beams extends continuously without bends in the spiral direction from the radially outer portion of the suspension member to the radially inner platform portion.

8. The apparatus of claim 1, wherein the beams do not intersect one another.

9. The apparatus of claim 1, wherein each beam of the plurality of beams extends from the radially outer portion to the radially inner platform portion, and in a spiral direction from the radially outer portion of the suspension member to the radially inner platform portion.

10. The apparatus of claim 1, further comprising a headphone including the speaker and a device for operatively coupling the speaker with a media player configured to send an electrical audio signal to the speaker.

11. The apparatus of claim 10, wherein the speaker is configured to be disposed as one of:

within an ear of a person using the headphone;

on an ear of a person using the headphone; and over an ear of a person using the headphone.

12. A method of forming a speaker, the method comprising:

providing a suspension member including a radially outer portion, a radially inner platform portion, and a plurality of beams, each beam of the plurality of beams extending from the radially outer portion to the radially inner platform portion, the beams of the plurality of beams configured such that a resonant frequency of a vibration member attached to the radially inner platform portion of the suspension member scales linearly with a beam width of the beams of the plurality of beams;

attaching the vibration member to the radially inner platform portion of the suspension member; and attaching the radially outer portion of the suspension member to a rim of a support structure such that the vibration member is suspended relative to the support structure.

13. The method of claim 12, further comprising forming the suspension member.

14. The method of claim 13, wherein forming the suspension member comprises configuring the beams of the plurality of beams such that the resonant frequency of the vibration member attached to the radially inner platform portion of the suspension member is between approximately 40 Hz and approximately 60 Hz.

15. The method of claim 13, wherein forming the suspension member comprises forming each beam of the plurality of beams to extend in a spiral direction from the radially outer portion of the suspension member to the radially inner platform portion.

16. The method of claim 13, wherein forming the suspension member comprises forming each beam of the plurality of beams to extend continuously without bends in the spiral direction from the radially outer portion of the suspension member to the radially inner platform portion.

17. The method of claim 12, further comprising:

sampling an electrical audio signal for a media device;

determining a peak bass frequency of the electrical audio signal; and configuring the beams of the plurality of beams of the suspension member such that the resonant frequency of the vibration member attached to the radially inner platform portion of the suspension member is at least approximately equal to the peak bass frequency of the electrical audio signal of the media device.

18. The method of claim 17, further comprising packaging the speaker and the media device in a common package for sale or distribution.

19. A kit including at least one speaker and a storage device storing media content configured to generate an electrical audio signal, wherein the at least one speaker comprises:

a support structure having a circumferentially extending rim;

a vibration member configured to be displaced within the support structure for generating vibrations responsive to receipt of the electrical audio signal when sent to the at least one speaker by a media player playing the media content; and a suspension member suspending the vibration member relative to the support structure, the suspension member including a radially outer portion attached to the rim of the support structure and a radially inner platform portion attached to the vibration member, the suspension member further including a plurality of beams, each beam of the plurality of beams extending from the radially outer portion to the radially inner platform portion, wherein the beams of the plurality of beams are configured such that a resonant frequency of the vibration member attached to the radially inner platform portion of the suspension member is at least approximately equal to a peak bass frequency of the electrical audio signal.

20. The kit of claim 19, wherein the media content is selected from the group consisting of music, a movie, and a video game.

* * * * *